United States Patent [19]

Governale

[11] Patent Number: 4,665,663

[45] Date of Patent: May 19, 1987

[54] MUNTIN ASSEMBLY AND METHOD OF INSTALLING

[75] Inventor: Bernard C. Governale, Duluth, Ga.

[73] Assignee: Peachtree Doors, Inc., Norcross, Ga.

[21] Appl. No.: 879,193

[22] Filed: Jun. 26, 1986

[51] Int. Cl.[4] ..... E06B 3/68

[52] U.S. Cl. ..... 52/456; 248/262

[58] Field of Search ..... 403/189, 187, 245, 246, 403/188, 241, 254, 256, 257; 52/202, 665, 456, 285, 311; 248/262, 74.2, 74.3, 73, 74.4, 74.5; 312/108, 111

[56] References Cited

U.S. PATENT DOCUMENTS 3,293,817 12/1966 MacGregor ..... 52/456

3,807,675 4/1974 Seckerson ..... 248/74.2

*Primary Examiner*—John E. Murtagh

*Attorney, Agent, or Firm*—Kimmel, Crowell & Weaver

[57] ABSTRACT

Muntin bar molded anchors are installed on the interior edges of a window sash or sliding door frame by utilizing a two-part anchor holding and nail driving device which is stabilized during use. Molded clips are frictionally installed in recesses formed in the ends of mountain bars and the clips are snap locked over crowned surfaces of the anchors to complete the installation of the muntin assembly.

3 Claims, 12 Drawing Figures

MUNTIN ASSEMBLY AND METHOD OF INSTALLING

BACKGROUND OF THE INVENTION

1. Technical Field

The present invention relates to improvements in muntin bar assemblies and to a simplified method of installing the same on window sashes or sliding doors.

2. The Prior Art

Prior U.S. Pat. No. 3,293,817 discloses a metal muntin bar structure of the type which simulates muntin bars which are permanent integral parts of a sash. The patent contains a discussion of the prior art including various proposals which have been made to simplify the installation of muntin bars by homeowners, and the drawbacks of these prior art arrangements.

One of the main drawbacks in the prior art, still present to a certain extent in the above-referenced patent, is the danger of breaking the window pane while nailing the muntin bar anchors into place on the sash frame.

SUMMARY OF THE INVENTION

The present invention is best summarized as a muntin bar assembly in which muntin bar molded anchor elements are nailed to a window sash or door frame at spaced intervals by utilizing a two-part implement which holds and stabilizes the anchor while driving a nail provided in a bore of the anchor into the interior edge of a window sash or sliding door frame with precision. A coacting molded clip includes a split shank engaged frictionally in a recess formed in the end of each muntin bar. Each clip includes a pair of opposing spring arms having interior detents which interlock with detent recesses of the anchor element when the clip is forced over a crowned surface of the anchor element to complete the installation of the muntin bar assembly.

The primary object of the invention is to simplify to the greatest possible extent the installation of simulating muntin bar assemblies on window sash or sliding doors by homeowners, while minimizing the likelihood of breaking window panes or damaging the window sash or sliding door frames during the installation process.

A further object of the invention is to provide a muntin bar assembly of extremely low cost which employs molded plastics anchor elements and clips, and in which the muntin bars can be formed of wood or can be molded or extruded from plastics.

Another important object of the invention is to provide a holding, stabilizing and nail driving device to simplify attaching the muntin bar anchor elements to the interior edges of sash or sliding door frames while minimizing the likelihood of breaking the window or door glass, or damaging the frames.

Other features and advantages of the invention will become apparent to those skilled in the art during the course of the following description.

DETAILED DESCRIPTION

Figure 1:
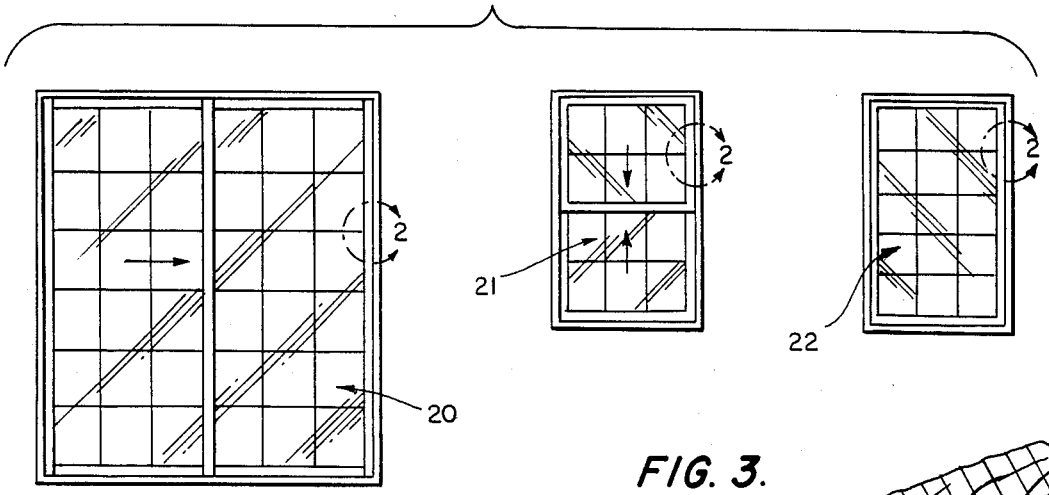
FIG. 1 is a composite elevational view showing a sliding door and two types of windows on which the muntin bar assembly according to the invention can be installed.
Figure 2:
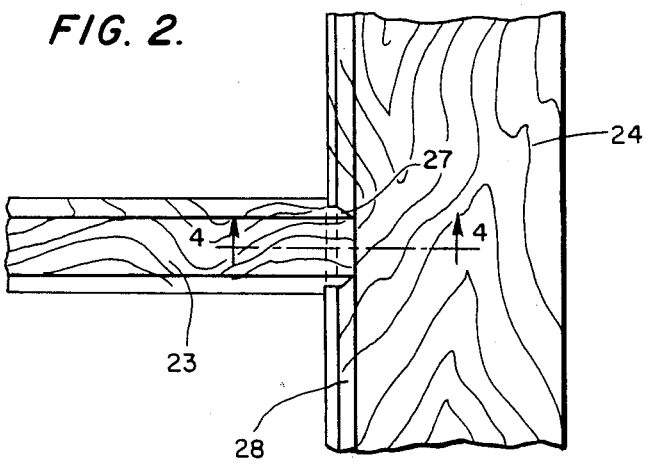
FIG. 2 is an enlarged fragmentary front elevational view of the area encompassed by the line 2 in FIG. 1.
Figure 3:
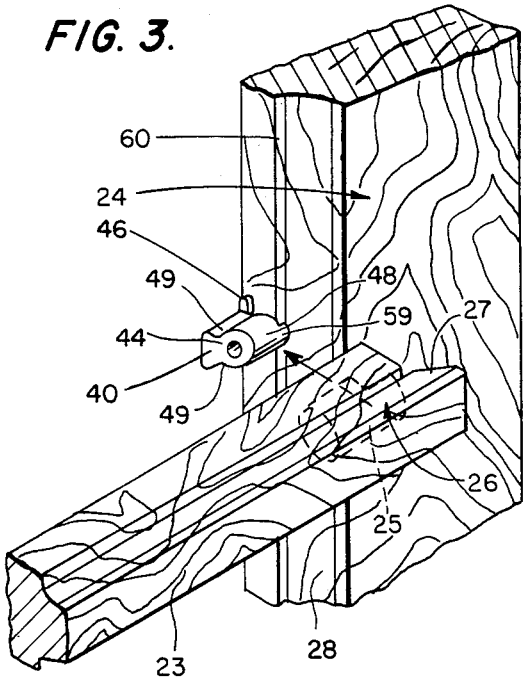
FIG. 3 is a fragmentary exploded perspective view of the invention showing a frame-mounted anchor element and a muntin bar mounted clip.
Figure 4:
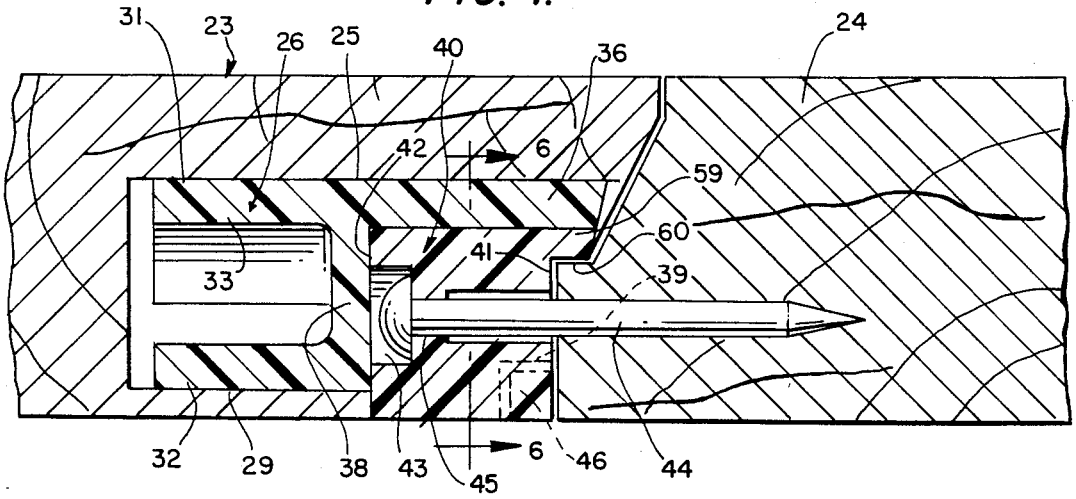
FIG. 4 an enlarged fragmentary horizontal section taken on line 4—4 of FIG. 2.
Figure 5:
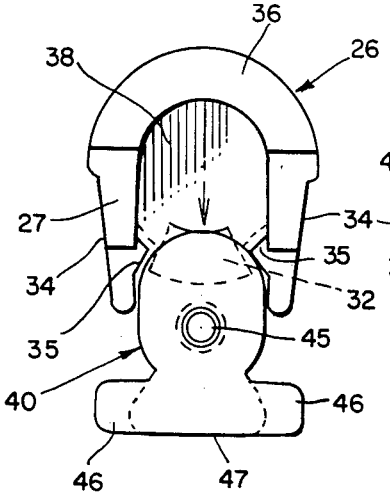
FIG. 5 is an exploded end elevation of an anchor element and clip prior to engagement.

Referring to the drawings in detail wherein like numerals designate like parts, a horizontally sliding door assembly 20, a vertically sliding sash window 21, and a horizontally swinging window 22, all of conventional construction, are shown in FIG. 1. The muntin bar assembly forming the main subject matter of this invention can be installed on any of the door or window assemblies 20, 21 or 22, shown in FIG. 1. Drawing FIGS. 2 through 7 show the details of the connection between a typical muntin bar 23 and a typical window sash or sliding door frame member 24 within the area encompassed by the line (2) in FIG. 1 of the drawings.

Figure 12:
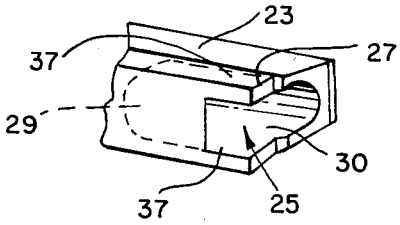
FIG. 12 is a fragmentary perspective view showing a recess formed in the end of a muntin bar to receive a molded clip element.

Each muntin bar 23 of the muntin bar assembly is formed of wood or, in some cases, plastics material. It is provided in each end with a recess 25, best shown in FIG. 12, for the reception of a molded plastics clip element 26. The end of the muntin bar 23 having the recess 25 is profiled as at 27 to mate with the profiled inner edge 28 of the frame member 24. The recess 25 includes an interior cylindrical bore portion 29 and an outer portion 30 which opens through the bottom of the muntin bar 23, FIG. 12.

The clip element 26 has a divided rear cylindrical shank 31 forming a spring tongue 32 and a half-round portion 33 spaced from the spring tongue 32. The divided shank 31 fits frictionally into the bore portion 29 when the clip element 26 is assembled with the muntin bar 23.

Figure 7:
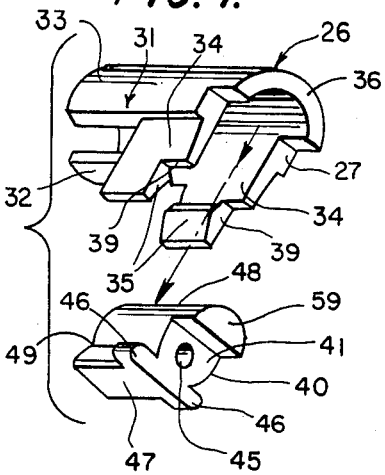
FIG. 7 is an exploded perspective view of the clip and anchor element.

The molded clip element 26 further includes at its forward end spaced approximately parallel spring legs 34 having inner side detent teeth 35, whose function will be described. An arcuate crown portion 36 joins the tops of the spring legs 34, as best shown in FIG. 7. The spring legs 34 project somewhat below the divided shank portion 31, as shown. When the clip element 26 is placed in the recess 25 of the muntin bar 23, the two side wall portions 37 of the muntin bar 23 lie parallel to the spring legs 34 and thus prevent rotation of the clip element 26 in the recess of the muntin bar 23. The clip element 26 includes an internal wall 38 between the divided shank 31 and crown portion 36 and spring legs 34, FIG. 4. Notches 39 are provided on each clip element at the lower ends of the spring legs 34.

A coacting molded plastics anchor element 40 for each clip element 26 is provided. Each anchor element 40 has a profiled end face 41 to match the opposing edge of the frame member 24, FIG. 4. The opposite end face 42 of the anchor element 40 is flat and recessed centrally at 43 to receive the head of a nail 44 provided with each anchor element 40 and received through a central bore 45 of the anchor element. At its forward end adjacent to the profiled end face 41, the anchor element 40 has a pair of opposite side lugs 46 received in the notches 39 of the clip element 26 in the muntin bar assembly process, to be further described. The bottom face 47 of the anchor element 40 is flat, FIG. 7.

Figure 6:
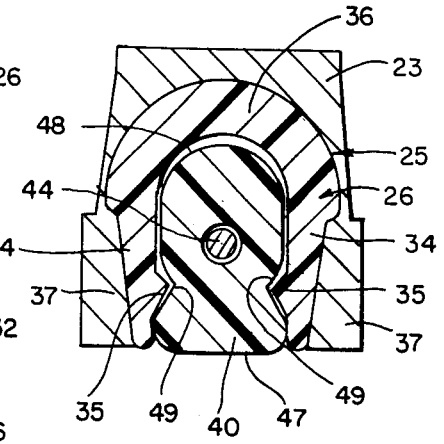
FIG. 6 is a fragmentary vertical section taken on line 6—6 of FIG. 4 showing the engagement of the clip with the anchor element.

The anchor element 40 has a rounded crown 48 received in the crown portion 36 of clip element 26, FIG. 6. The anchor element, on its opposite sides and somewhat above its bottom face 47, has detent recesses 49 adapted to receive the detent or locking teeth 35 on the spring arms 34 of clip element 26. When the clip element 26 is assembled with the muntin bar 23, as described, it is merely pressed over the crown 48 of anchor element 40 which is attached to the frame member 24, and the clip element becomes snap locked to the anchor element 40, as best shown in FIG. 6.

Figure 8:
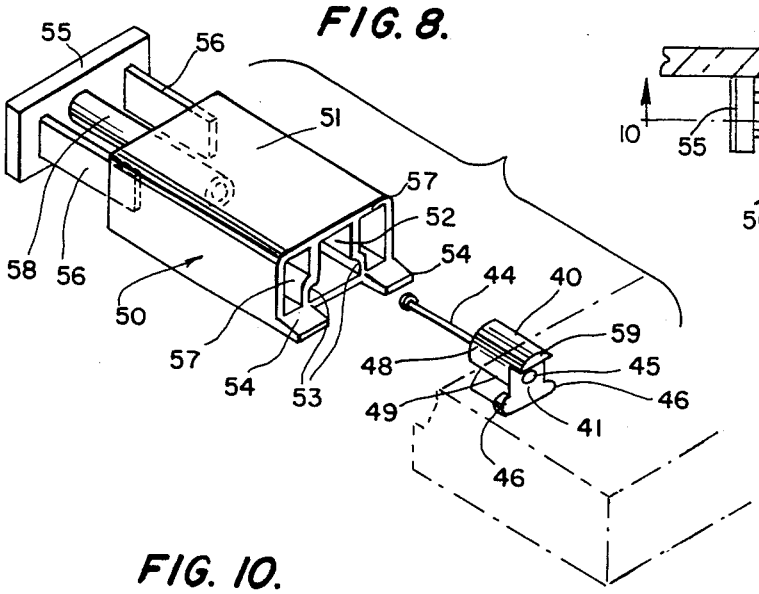
FIG. 8 is an exploded perspective view showing an anchor element, its attaching nail and a device for holding and stabilizing the anchor element and for assisting in driving the nail into the adjacent frame of a window or sliding door.
Figure 9:
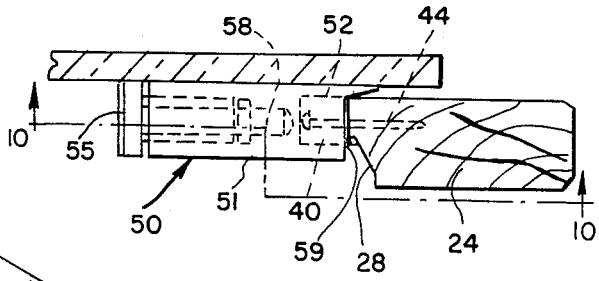
FIG. 9 is an elevational view, partly in cross section, showing the method of installing the anchor element on a window sash or sliding door frame by using the device shown in FIG. 8.
Figure 10:
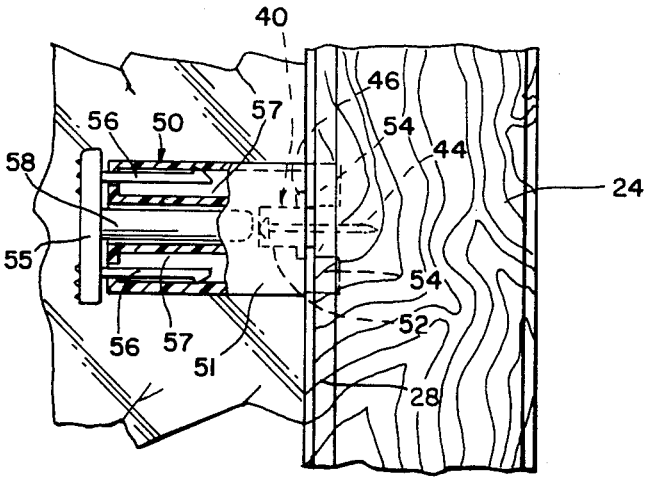
FIG. 10 is an elevational view, partly in section, taken on line 10—10 of FIG. 9.

An important feature of the present invention resides in the provision of an implement 50, FIGS. 8 to 10, for holding and stabilizing the anchor element 40 and assisting in nailing it to the frame member 24 in a precision manner without damaging the adjacent frame member or breaking a door or window pane. This implement or device comprises a body portion 51 having a forward end cavity 52 adapted to receive and hold one of the anchor elements 40 therein. The cavity 52 has recesses 53, FIG. 8, adapted to receive the two lugs 46 of the anchor element 40 to stabilize the anchor element. The body portion 51 at its leading end on opposite sides of the chamber 52 has two wedge fingers 54 which can engage one edge of the frame member 24, FIG. 9, during the installation process for the anchor element 40 for further stabilization thereof.

The implement 50 further comprises a driver 55 having guide arms 56 within channels 57 of the body portion 51, and a central nail driving pin 58 aligned coaxially with the head of the nail 44 carried by each anchor element 40.

The arrangement is such that with the implement 50 holding the anchor element 40 and positioned relative to the frame member 24, as shown in FIG. 9, the installer can tap the driver 55 with a hammer and the pin 58 will drive the nail 44 squarely into the frame member 24 to thereby permanently fixedly attach the anchor element 40 to the frame member 24. The projecting end portion 59 of the anchor element 40 laps a surface 60, FIG. 4, of the profiled frame member 24 to prevent rotation of the anchor element 40 thereon.

With the anchor elements 40 fixed to the door or window frame members in properly spaced relationship, and the clip elements 26 installed in the recesses 25 of the muntin bars 23, the entire muntin bar assembly can be snapped into place on the particular door or window by the simple engagement of the clip elements 26 with the anchor elements 40 in the manner previously described for a single joint or connection of the assembly.

Figure 11:
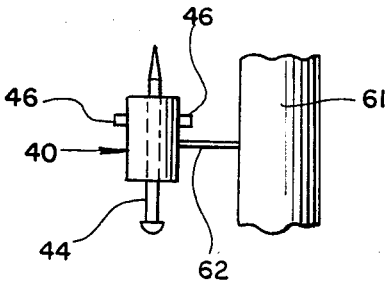
FIG. 11 is an elevational view of an anchor element as molded and showing a break-off bar and a nail assembled with the anchor element.

FIG. 11 shows that the anchor elements 40 are connected to a continuous sprue bar 61 by break-off arms 62 in the molding process. A dozen or more anchor elements 40 on each side of the sprue bar 61 are molded as a unit with the sprue bar followed by breaking off of the arms 62 to separate the anchor elements 40.

While the present invention is illustrated and described as a muntin bar assembly and method of installing, it should be recognized that the invention is not limited to this particular usage or adaptation, and may be embodied in other devices or attachments based on the same principle described in the application and shown in the drawings. For example, instead of a muntin bar assembly, the invention can be embodied in a decorative grille, a decorative glass or plaque, shutters, blinds, or the like, employing the same structures and fastening methods disclosed in this application.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A muntin bar assembly for doors or windows comprising a muntin bar having a recessed end, a clip element frictionally held in the recessed end of the muntin bar and having a pair of spaced spring legs provided on their inner sides with opposing detent teeth, a frame member having an inner margin extending perpendicular to the muntin bar, an anchor element fixedly secured to the inner margin of the frame member and projecting inwardly therefrom and having an arcuate top and a pair of opposite side detent recesses adapted to receive and interlock with said detent teeth of the spring legs of the clip element when the spring legs are forced over the arcuate top of the anchor element, the recessed end of the muntin bar having side wall portions disposed outwardly of the spring legs and engaging the latter to prevent rotation of the clip element relative to the muntin bar, the clip element having a pair of opposite side notches in said spring legs, and opposite side lugs on the anchor element engaging in said notches when the clip element is engaged with the anchor element.

2. A muntin bar assembly for doors or windows as defined in claim 1, and the inner margin of said frame member being profiled, and a projection on one end of the anchor element engageable with a surface of the profiled inner margin of said frame member to resist rotation of the anchor element relative to the frame member.

3. A muntin bar assembly for doors or windows as defined in claim 1, and said clip element including a rear split cylindrical shank portion extending rearwardly of said spring legs, said recessed end of the muntin bar having a cylindrical bore receiving said split cylindrical shank portion frictionally, and said recessed end of the muntin bar and the forward end of the clip element being profiled to match a profile of said inner margin of the frame member.

* * * * *